United States Patent [19]

Cheng et al.

[11] 4,036,289

[45] July 19, 1977

[54] HEAT EXCHANGER TUBE BUNDLE SUPPORT SYSTEM

[75] Inventors: Shih-che Cheng, San Diego; Jay Stephen Kaufman, Del Mar, both of Calif.

[73] Assignee: General Atomic Company, San Diego, Calif.

[21] Appl. No.: 542,518

[22] Filed: Jan. 20, 1975

[51] Int. Cl.[2] ..... F28D 7/00; F28F 9/00

[52] U.S. Cl. ..... 165/82; 122/510; 138/106; 165/76; 165/162; 165/163; 165/172; 165/178; 248/68 CB

[58] Field of Search ..... 165/76, 82, 172, 178, 165/162, 163; 122/510; 138/106, 107; 248/68 R, 68 CB

[56] References Cited

U.S. PATENT DOCUMENTS

| | | | |
|---|---|---|---|
| 1,796,944 | 3/1931 | Jones | 165/82 |
| 2,143,157 | 1/1939 | Kotzebue | 165/82 |
| 2,980,404 | 4/1961 | Andersen et al. | 165/162 X |
| 3,286,767 | 11/1966 | Evans | 165/82 |
| 3,422,884 | 1/1969 | Otten | 165/178 X |
| 3,437,297 | 4/1969 | Jirka et al. | 248/68 CB |
| 3,595,309 | 7/1971 | Hawkins | 165/172 X |
| 3,682,422 | 8/1972 | Evans | 248/68 CB |
| 3,896,874 | 7/1975 | Bongaards et al. | 165/82 |

*Primary Examiner*—Albert W. Davis, Jr.
*Assistant Examiner*—Sheldon Richter
*Attorney, Agent, or Firm*—Fitch, Even, Tabin & Luedeka

[57] ABSTRACT

A heat exchanger is described wherein a tube bundle comprising a plurality of tubes having convolutions of different radii on a common axis is provided with at least one spacer structure for supporting the tubes in spaced relation. The spacer structure comprises a plurality of parallel bars arranged in pairs and in which semi-circular recesses are formed in abutting surfaces to accommodate the convolutions of the tubes. The bars in adjacent pairs have facing surfaces in an interfitting configuration with clearances therein sufficient to accommodate thermal expansion differences in the adjacent tubes.

5 Claims, 2 Drawing Figures

HEAT EXCHANGER TUBE BUNDLE SUPPORT SYSTEM

This invention relates generally to heat exchangers and, more particularly, to heat exchanger incorporating a tube bundle with coaxial convolutions and an improved spacer structure for supporting the tubes in spaced relation.

Certain types of heat exchangers are provided with tube bundles employing heat exchanger tubes of a convoluted configuration. Typically, the convolutions are of different radii and are arranged along a common axis. For example, the convolutions may be helical in configuration Comission. each tube forming a helix having a different radius and with the respective tubes nested within each other to form the tube bundle. In some cases, more than one tube may have the same helical radius such that the nesting is effected longitudinally of the tube bundle as well as radially. A heat exchanger of the general type described is shown and described in greater detail in U.S. Pat. No. 3,520,356, Bell et al., issued July 14, 1970 and assigned, by mesne assignments, to the United States of America as represented by the U.S. Atomic Energy Commision.

In order to maintain the desired spacing between the tubes and the respective convolutions thereof, heat exchangers of the type described generally employ a suitable spacer structure. Typical spacer structures used in the prior art have included support plates having circular openings therein through which the tubes are threaded. Although satisfactory in many respects, there are certain drawbacks to employment of such support structures. The necessity for threading the tubes through the support plates makes assembly and disassembly relatively difficult. Differential thermal stresses among the various tubes necessitate that the support plates be made of high grade structural material. Because some clearance between the tube and the support plate through which it is threaded is necessary to permit the threading, relatively expensive wear protection devices such as sleeves must be employed. Such devices also protect against wear as a result of dynamic stresses due to flow-induced vibration.

It is an object of the invention to provide an improved heat exchanger.

Another object of the invention is to provide a heat exchanger employing convoluted tubes which is relatively easy to assemble and disassemble.

Another object of the invention is to provide a heat exchanger employing convoluted tubes which is relatively lower in cost than prior art structures and in which dynamic stresses due to flow-induced vibration and seismic excitation are minimized.

Figure 1:
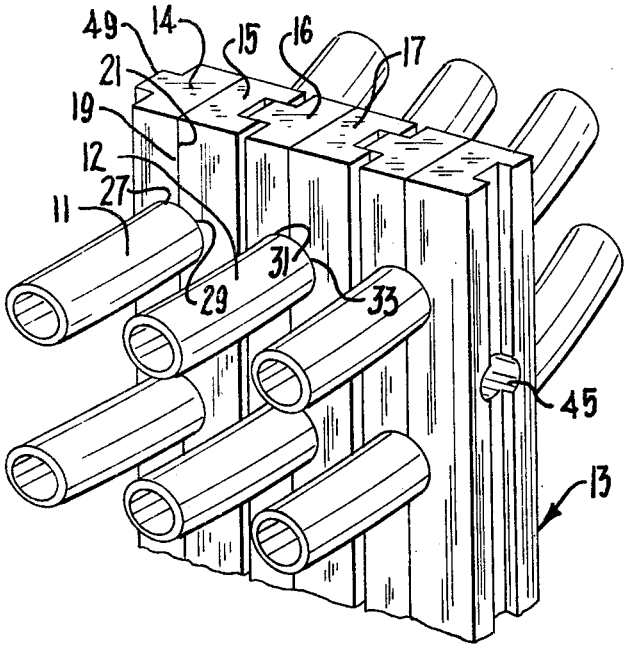
Figure 2:
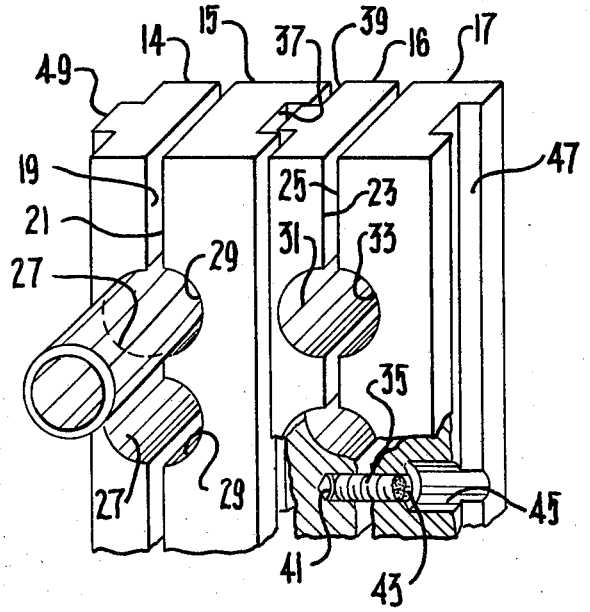

Other objects of the invention will become apparent to those skilled in the art from the following description, taken in connection with the accompanying drawings wherein:

FIG. 1 is a perspective view illustrating a portion of a heat exchanger constructed in accordance with the invention; and FIG. 2 is an enlarged perspective broken out view of a smaller portion of the heat exchanger illustrated in FIG. 1.

Very generally, the heat exchanger of the invention incorporates a tube bundle comprising a plurality of convoluted tubes 11 and 12, each of which comprises a plurality of convolutions and with the convolutions in the respective tubes having different radii. A spacer structure 13 is employed for supporting the tubes in spaced relation. The spacer structure comprises a plurality of parallel bars 14, 15, 16, and 17 arranged in pairs. The bars in each pair have abutting surfaces 19, 21, 23 and 25, respectively, with semi-circular recesses 27, 29, 31 and 33 therein which form form circular openings accommodating the convolutions of one of the tubes. Means 35 secure the bars in each pair together to clamp the convolutions of the associated tube in the circular openings. The bars in adjacent pairs have facing surfaces 37 and 39 formed in an interfitting configuration having clearances therein sufficient to accommodate thermal expansion differences in the adjacent tubes.

Referring now more particularly to FIG. 1, the heat exchanger incorporating the invention is shown in a partial view. The heat exchanger includes a plurality of tubes 11 and 12, each of which is wound on a helix. The radius of the helix of the tube 11 is less than the radius of the helix of the tube 12 so that the tube 11 nests within the tube 12. Typically, more than two helical tubes would be used in the structure of FIG. 1, with each helical tube being formed in a helix of a different radius to nest with the others. Suitable tubes and headers, not shown, are provided for conducting fluid to and from the tubes 11 and 12 as is known in the art. A second fluid is passed through the spaces between the tubes, usually parallel with the direction of the axis of the helices, which is common to all the tubes, to cause a heat exchange through the walls of the tubes 11 and 12 between the two fluid. A heat exchanger of this general type is shown and described in greater detail in the previously mentioned patent.

In order to support the tubes 11 and 12 in a spaced relation, the spacer structure 13 is provided. The spacer structure in the illustrated embodiment includes a plurality of support bars 14, 15, 16, and 17, the details of which may be more clearly seen in FIG. 2. The support bars are arranged in pairs with the bars 14 and 15 comprising one pair and the bars 16 and 17 comprising another pair. The bars are parallel with each other and parallel with the axes of the helices formed by the tubes. The bars in each pair have abutting surface with semi-circular recesses therein. Thus, the abutting surfaces 19 and 21 of the bars 14 and 15 are provided with a plurality of semi-circular recesses 27 and 29, respectively. Similarly, the abutting surfaces 23 and 25 of the bars 16 and 17 have semi-circular recesses 31 and 33 formed therein. The recesses form circular openings which accommodate the convolutions of the tubes. Thus, the circular openings formed by the recesses 27 and 29 accommodate the convolutions of the tube 11 and the recesses 31 and 33 form circular openings which accommodate the convolutions of the tube 12. Naturally, where there are two or more tubes which are wound on helices having the same radius and which are nested longitudinally, the convolutins of several tubes may be accommodated by the same pair of spacer bars.

The depth of the recesses in the support bars is slightly less than the outer radius of the tubes 11 and 12. Accordingly, some clearance is left between the facing surfaces 19 and 21 and between the facing surfaces 23 and 25. Aligned threaded openings 41 and 43 are provided in the facing surfaces 23 and 25 of the bars 16 and 17. Similar threaded openings, not shown, are provided in the facing surfaces 19 and 21 of the bars 14 and 15. The threaded fastener 35 is threaded into the threaded openings 41 and 43 to secure the support bars 16 and 17 together. This clamps the tubes 12 between the bars 16 and 17. A similar clamping effect by the unillustrated threaded fasteners and holes clamps the bars 14 and 15 against the tubes 11. Access to the threaded fastener 35 for assembly and disassembly purposes is provided by an access opening 45 provided in the bars 17. Similar access openings are provided in the bars 15.

The bars in adjacent pairs have facing surfaces formed in an interfitting configuration. Thus, the bars 15 and 16 in the adjacent pairs 14–15, 16–17, have facing surfaces 37 and 39 which interfit. In the illustrated embodiment, the surfaces 39 and 37 are of a tongue and groove configuration, respectively, so that the bars 15 and 16 are interlocked. The bar 17 is provided with a surface 47 having a groove configuration for interfitting with the adjacent bar in the next adjacent pair, not shown. The bar 14 is provided with a surface 49 having a tongue configuration for interfitting with the adjacent bar, not shown, of the next adjacent pair.

As may be seen in FIG. 2, the tongue and groove configuration surfaces 37 and 39 are provided with clearances therein sufficient to accommodate thermal expansion differences in the adjacent tubes. These clearances exist in both the radial and circumferential direction of the tubes and provide several advantages. First of all, the vibration or similar dynamic movement of the tubes induced by the flow of fluid, and any tube movement due to seismic excitation, are readily accommodated by the clearances and allows for the dissipation of vibrational energy, thereby reducing the vibration levels of the tubes. Also, thermal expansion of the various elements of the heat exchanger may be accommodated by the clearances, eliminating the thermal stresses produced by the incompatibility of the thermal expansion of adjacent coils. Since the coils are of different helical radii, and therefore of different length, these differences in thermal expansion are inherent in the particular structure.

The design of the invention provides a heat exchanger which is easily assembled and disassembled, since the threading of tubes through support plates is unnecessary. Rather, each of the support bars is positioned in place as the tubes are positioned, the support bars being supported at each end in the heat exchanger structure by means, not illustrated. The clearances between the adjacent bars reduce differential thermal stresses and as a result, lower grade materials may be used for the support bars. Expensive wear protection devices such as sleeves are unnecessary between the tube and the support, since the tubes may be clamped directly by the support bars. By mismatching the natual frequencies of the tubes in the horizontal and vertical directions, fluid-elastic instability of the tubes may be prevented.

It may be seen, therefore, that the invention provides an improved heat exchanger which is easily assembled and disassembled, which is relatively low in cost, and in which vibration levels are significantly reduced and differential thermal expansion is readily accommodated.

Various modifications of the invention in addition to those shown and described herein will become apparent to those skilled in the art from the foregoing description and accompanying drawings. Such modifications are intended to fall within the scope of the appended claims.

What is claimed is:

1. In a heat exchanger, a tube bundle comprising a plurality of coaxil convoluted tubes with the convolutions of the respective tubes having different radii, and a spacer structure comprising a plurality of elongated parallel bars arranged in pairs, said bars in each pair having abutting surfaces with semicircular recesses therein to form circular openings accommodating the convolutions of one of said tubes means intermediate their ends securing said bars in each pair together such as to cause said bars in each pair to claim the convolutions of the associated tube in said circular openings, said bars in adjacent pairs having facing surfaces formed in an interfitting tongue and groove configuration extending continuously the full length thereof, said tongues and grooves having radial and circumferential clearances therein sufficient to accommodate radial and circumferential thermal expansion differences in the adjacent tubes.

2. The apparatus of claim 1 wherein each of said tubes is wound in a helical configuration, each of said helices being of different diameters.

3. The apparatus of claim 2 wherein said bars are parallel with the axes of said helices.

4. The apparatus of claim 1 wherein said bars in each pair are secured by threaded fasteners.

5. The apparatus of claim 1 wherein said tubes have natural frequencies in the horizontal and vertical directions which are mismatched.

* * * * *

UNITED STATES PATENT AND TRADEMARK OFFICE

CERTIFICATE OF CORRECTION

PATENT NO. : 4,036,289

DATED : July 19, 1977

INVENTOR(S) : Cheng, et al

It is certified that error appears in the above-identified patent and that said Letters Patent are hereby corrected as shown below:

Col. 1, line 6 after "to" insert --a--.

Col. 1, line 15 "Commission." should be --with--.

Col. 2, line 7 "form" appears twice.

Col. 2, line 31 "fluid" should be --fluids--.

Col. 2, line 43 "surface" should be --surfaces--.

Col. 4, line 26
Claim 1 after "tubes" insert a comma.

Col. 4, line 28
Claim 1 "claim" should be --clamp--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*